US011191336B2

(12) United States Patent
Freeman

(10) Patent No.: US 11,191,336 B2
(45) Date of Patent: Dec. 7, 2021

(54) RECHARGEABLE HAIR STYLING TOOL

(71) Applicant: Durham Enterprises Corporation, Salt Lake City, UT (US)

(72) Inventor: Michael Brian Freeman, North Salt Lake, UT (US)

(73) Assignee: Durham Enterprises Corporation, Salt Lake City, UT (US)

( * ) Notice: Subject to any disclaimer, the term of this patent is extended or adjusted under 35 U.S.C. 154(b) by 0 days.

(21) Appl. No.: 16/864,126

(22) Filed: Apr. 30, 2020

(65) Prior Publication Data

US 2020/0383446 A1 Dec. 10, 2020

Related U.S. Application Data

(60) Provisional application No. 62/857,723, filed on Jun. 5, 2019.

(51) Int. Cl.
*A45D 1/04* (2006.01)
*A45D 1/06* (2006.01)
(Continued)

(52) U.S. Cl.
CPC ..... *A45D 1/04* (2013.01); *A45D 1/06* (2013.01); *A45D 2/001* (2013.01); *A45D 2/36* (2013.01); *A45D 2001/045* (2013.01)

(58) Field of Classification Search
CPC ... A45D 1/04; A45D 1/06; A45D 1/10; A45D 1/12; A45D 1/14; A45D 1/16;
(Continued)

(56) References Cited

U.S. PATENT DOCUMENTS 3,487,197 A * 12/1969 Elia ..... A45D 4/16 219/222
3,731,694 A 5/1973 Moro
(Continued)

FOREIGN PATENT DOCUMENTS

GB 2567448 A 4/2019
GB 2567449 A 4/2019
(Continued)

OTHER PUBLICATIONS

USPTO acting as International Searching Authority, "International Search Report and Written Opinion," International Application No. PCT/US2020/036295, dated Aug. 6, 2020.

*Primary Examiner* — Yogesh P Patel
*Assistant Examiner* — Jennifer Gill
(74) *Attorney, Agent, or Firm* — Dentons Durham Jones Pinegar

(57) ABSTRACT

A rechargeable hair styling tool may be plugged into an electrical outlet to enable charging of each battery and operation of the hair styling tool. Electronics of the hair styling tool may enable it to alternately operate under power from the battery or batteries (i.e., stored power) while the hair styling tool is unplugged from an electrical outlet (e.g., a wall socket, etc.) and under power of an external source of electricity while the hair styling tool is plugged into the electrical outlet. Each heating element of such a rechargeable hair styling tool may be heated when the hair styling tool is plugged in and, once each heating element has been heated to a sufficient temperature, continue to function under power supplied by the battery or batteries of the rechargeable hair styling tool.

14 Claims, 4 Drawing Sheets

(51) Int. Cl.
*A45D 2/36* (2006.01)
*A45D 2/00* (2006.01)

(58) Field of Classification Search
CPC ..... A45D 2001/045; A45D 1/28; A45D 1/18; A45D 1/20; A45D 2/00; A45D 2/001; A45D 2/002; A45D 2/24; A45D 2/36; A45D 2/367; A45D 2/40; A45D 7/02
See application file for complete search history.

(56) References Cited

U.S. PATENT DOCUMENTS 4,101,756 A * 7/1978 Yamano ..... A45D 1/20 132/232
4,166,472 A * 9/1979 Battaglia ..... A45D 4/16 132/229
4,354,093 A 10/1982 Zago
4,641,010 A * 2/1987 Abura ..... A45D 1/04 132/212
4,739,242 A * 4/1988 McCarty ..... H02J 7/0013 30/DIG. 1
5,124,532 A * 6/1992 Hafey ..... A45D 1/00 132/229
5,526,829 A 6/1996 Smith
5,746,228 A * 5/1998 Parker ..... A45D 1/04 132/232
6,075,341 A 6/2000 White et al.
6,119,461 A * 9/2000 Stevick ..... F25B 21/04 62/3.3
6,703,587 B2 * 3/2004 Sena ..... A45D 1/20 219/222
8,541,715 B2 9/2013 Overend et al.
9,474,347 B2 10/2016 Pedroarena
D779,728 S 2/2017 Bermudez et al.
9,681,723 B2 6/2017 Bursey
9,788,626 B2 10/2017 Pedroarena
9,848,683 B2 12/2017 Sayers et al.
10,186,822 B2 1/2019 Hogan
10,327,528 B2 6/2019 Cowdry et al.
10,463,143 B2 11/2019 Harris et al.
2005/0183283 A1 8/2005 Evanyk et al.
2005/0284856 A1 * 12/2005 Cafaro ..... A45D 1/04 219/222
2007/0283978 A1 * 12/2007 Montagnino ..... A45D 1/20 132/211
2012/0227758 A1 * 9/2012 Ford ..... A45D 1/04 132/211
2015/0157112 A1 * 6/2015 Daibes ..... A45D 20/12 132/229
2015/0201726 A1 7/2015 Prats
2015/0223582 A1 * 8/2015 Pedroarena ..... A45D 1/04 34/97
2015/0335120 A1 11/2015 Moore et al.
2018/0014618 A1 1/2018 Ohgi et al.

FOREIGN PATENT DOCUMENTS

GB 2567450 A 4/2019
WO 2019073199 A1 4/2019

* cited by examiner

RECHARGEABLE HAIR STYLING TOOL

CROSS-REFERENCE

A claim for priority to the Jun. 5, 2019 filing date of U.S. Provisional Patent Application No. 62/857,723, titled RECHARGEABLE HAIR STYLING TOOL ("the '723 Provisional Application"), is hereby made pursuant to 35 U.S.C. § 119(e). The entire disclosure of the '723 Provisional Application is hereby incorporated herein.

TECHNICAL FIELD

This disclosure relates generally to electrically operated, handheld hair styling tools and, more specifically, to rechargeable (i.e., battery operated) hair styling tools. Even more specifically, this disclosure relates to hair styling systems that include rechargeable hair styling tools and complementary charging elements, as well as to methods for using rechargeable hair styling tools.

RELATED ART

A variety of electrically operated, handheld hair styling tools have long been available to consumers. Among the more common types of hair styling tools are curling irons, flat irons (or straightening irons), crimping irons, heated roller brushes, and straightening brushes. Conventionally, hair styling tools are placed on a secure surface, such as a countertop, plugged into an electrical outlet, and turned on to allow their heating elements to heat to a temperature suitable for the desired type of hair styling. Once the heating element(s) has (have) reached a suitable temperature, an individual may use the hair styling tool to style her own hair or the hair of another individual. Typically, a conventional hair styling tool remains plugged into an electrical outlet during its use, limiting areas where it may be used.

Although full sized battery operated hair styling tools are now available, the battery lives of such tools are limited. Limits on the storage capacities of batteries with sizes and weights that are conducive to use with handheld hair styling tools prevent such batteries from providing sufficient power to heat the heating elements of a full sized hair styling tool to a sufficient temperature to style hair and then maintain that temperature for a sufficient duration to enable an individual to completely style the hair. To provide a full sized hair styling tool with sufficient power to enable it to be used for prolonged periods of time (e.g., about fifteen minutes, about twenty minutes, half an hour, or longer), a battery would have to have a size and a weight that would add significantly to the size or the weight of the hair styling tool, making the hair styling tool difficult to use since hair styling tools are often held by and operated with a single hand of an individual for prolonged durations.

SUMMARY

In one aspect, hair styling tools are disclosed. Upon disconnecting, or uncoupling, the hair styling tool from the electrical outlet, the electronics may automatically enable power from the battery or batteries to flow to and, thus, provide power to the elements (e.g., one or more heating elements, a display, etc.) of the hair styling tool.

Such a hair styling tool may include a handle, a hair styling feature with at least one heating element, the electronics, the at least one battery, and at least one electrical connector. These features may be at least partially defined and/or carried by a housing of the hair styling tool. The hair styling tool may include one or more user interfaces. At least one user interface of the hair styling tool may comprise a user control (e.g., a switch, one or more inputs that enable an individual to set a temperature of the hair styling feature, etc.). At least one user interface may comprise an output device (e.g., a display, one or more light-emitting diodes (LEDs), etc.) to provide an individual who uses the hair styling tool with a readily discernable indicator of a status of the hair styling tool (e.g., whether the hair styling tool is on, a temperature of the hair styling feature, battery charge, etc.).

The handle may have a configuration that enables an individual to grasp, manipulate, and operate the hair styling tool with one hand.

The hair styling feature of the hair styling tool may include at least one surface that may be heated. A configuration of the hair styling feature may facilitate interaction between the at least one surface and an individual's hair in a manner that will enable heat from the at least one surface to have a desired effect on the individual's hair (e.g., a curling effect, a straightening effect, a crimping effect, etc.). In embodiments where the hair styling tool comprises a curling iron, the hair styling feature may comprise a barrel and, optionally, a clamp. In embodiments where the hair styling tool comprises a heated brush, the hair styling feature may comprise a heating surface and bristles that protrude from the heating surface. In embodiments where the hair styling tool comprises a straightening iron, or a flat iron, the hair styling feature may include a clamp that carries a pair of opposed straightening plates. In embodiments where the hair styling tool comprises a crimping iron, the hair styling feature may include a clamp that carries a pair of opposed crimping plates. Each heating element may be associated with the hair styling feature in a manner that conducts heat to the appropriate surface of the hair styling feature to enable the hair styling feature to be heated to a desired temperature.

The electronics of the hair styling tool include one or more switches, which may also be referred to as a switch or as a master control unit (MCU), that controls the flow of power through circuitry of the hair styling tool; thus, the switch may operate under control of logic (e.g., firmware, etc.). For example, the switch may control the flow of power between an external power source, one or more batteries of the hair styling tool, and one or more heating elements of the hair styling tool. More specifically, in a first state, the switch may enable power to flow to the battery or batteries. In a second state, the switch may enable the flow of power to bypass the battery or batteries and flow directly to the heating element(s). For example, when the hair styling tool is turned off (e.g., by way of a user-operated power switch or power button accessible from an exterior of the hair styling tool, etc.) and is plugged into an external power source (e.g., to the electrical grid, or mains power, such as by way of an AC-to-DC adapter plugged into a wall socket; to a larger capacity external battery; etc.), directly or through a base with which the hair styling tool has been assembled, the switch (e.g., in the first state, etc.) may direct power to each battery until each battery stores an initial threshold charge or until each battery is fully charged. In various embodiments, when the hair styling tool is turned on (e.g., by way of the user-operated power switch or power button, etc.) and connected to or otherwise in communication with the external power source, the switch (e.g., in the second state, etc.) that control(s) the flow of power through circuitry of the hair styling tool may enable power to flow from the external power source to the heating element(s), bypassing the battery or batteries and heating the heating element(s) even when each battery is completely discharged, or dead; thus, the hair styling tool can operate even when its battery(ies) is (are) dead. In such embodiments, when the hair styling tool is turned on and disconnected from the external power source, the switch may enable power to flow from the battery(ies) to the heating element(s).

In a more specific embodiment, with the hair styling tool turned off and receiving power from an external power source, the switch directs power to the battery until the battery has been charged to the initial threshold or until the battery has been completely charged. Once the battery is fully charged, the switch may terminate the flow of power from the external power source to the battery. When the hair styling tool is turned on and continues to receive power from the external power source, the switch may control the flow of power to the heating element(s) of the hair styling tool and/or to the battery(ies). The switch may direct the flow of power to the heating element(s) of the hair styling tool until each heating element is heated to an initial heated temperature. Once each heating element is heated to the initial heated temperature, the switch may direct power to each battery if it is not fully charged. If each battery is still fully charged, the switch may terminate the flow of power until a heating element cools to a minimum heated threshold temperature. Thus, when the hair styling tool is plugged into an external power source and turned on, the logic that controls the switch may prioritize heating of the heating element(s) over charging of the battery(ies).

Once each heating element of the hair styling tool has been heated to an initial heated temperature or a maximum threshold temperature, the hair styling tool may be disconnected from the external power source, and the switch may enable power to flow from the battery(ies) to each heating element to substantially maintain each heating element at a target temperature, which may be the same as or less than the initial heated temperature of the heating element. In some embodiments, when the capacity of the battery reaches a minimum threshold, the switch may terminate the flow of power from the battery to the heating elements.

In other embodiments, power from the external power source of the hair styling tool may flow through the battery or batteries. When such a hair styling tool is turned off and connected to or otherwise in communication with the external power source, the battery or batteries may charge. When such a hair styling tool is turned on and connected to or otherwise in communication with the external power source, power may flow from the battery or batteries to the heating element(s).

In addition to the switch, the electronics may include components that enable the heating elements of the hair styling feature to operate as intended (e.g., a thermostat, resistors, etc.). The electronics may also include components that facilitate user input and/or provide an output that may be readily discerned by an individual who uses the hair styling tool. For example, the electronics may include an on/off indicator. The electronics may also enable an individual to set a target temperature and see an actual temperature. In addition, the electronics may provide a battery charge indicator and/or a battery life indicator.

The electronics may be carried, or housed, by a housing of the hair styling tool. In addition to carrying the electronics, the housing may define a handle of the hair styling tool. The handle may enable an individual to hold the hair styling tool during use and, in some embodiments, operate the hair styling tool.

The hair styling feature of the hair styling tool may be located adjacent to the handle. The hair styling feature may comprise any suitable type of hair styling feature, including, without limitation, flat elements of a flat iron (or straightening iron), grooved elements of a crimping iron, a substantially cylindrical element of a curling iron, heating elements of straightening brushes and heated roller brushes, and the like.

A hair styling tool of this disclosure may be used with one or more charging elements; together, the hair styling tool and the charging element(s) may comprise a hair styling system. As one example, the charging element may comprise a conventional AC/DC adapter, or "charging cord," with a first end (i.e., an AC end) that plugs into an electrical outlet and a second end (i.e., a DC end) that plugs into a charging port of the hair styling tool. The charging port may be located in an end of a handle of the hair styling tool.

As another example, a charging element may comprise a base that can hold the hair styling tool in a desired orientation. Such a base may include a receptacle shaped complementary to a portion of the hair styling tool. For example, the hair styling feature of the hair styling tool. A shape of the receptacle may determine the orientation of the complementary portion of the hair styling tool upon introduction of the complementary portion of the hair styling tool into the receptacle. The base and its receptacle may, in some embodiments, have configurations that enable the base to support the hair styling tool in an at least partially upright orientation (e.g., at a non-perpendicular angle relative to a surface that supports the base, etc.) or an upright orientation (e.g., perpendicularly relative to the surface that supports the base, etc.).

The receptacle of the base may receive a styling end of the hair styling tool, which carries the styling feature of the hair styling tool. The receptacle may receive the entire styling feature (e.g., flat elements of a flat iron, grooved elements of a crimping iron, a substantially cylindrical element of a curling iron, heating elements of straightening brushes and heated roller brushes, etc.). In some embodiments, the receptacle may receive the styling feature in its entirety, for example, by completely laterally surrounding the styling feature. In such embodiments, the base may prevent inadvertent contact (e.g., by an individual, etc.) with the styling feature as the hair styling tool is carried by the base.

Since the base is a charging element, it may also include electrical contacts that can engage corresponding electrical contacts of the hair styling tool when an appropriate portion of the hair styling tool is properly inserted into the receptacle. Safety measures may be included in the design of the base to limit exposure of electrical contacts while the electrical contacts are electrified. For example, electricity may not flow to the electrical contacts when the receptacle of the base is open or empty (e.g., it does not hold a portion of a hair styling tool, etc.). As another example, when the receptacle of the base is open or empty, access to the electrical contacts may be physically limited, for example, by retracting the electrical contacts, covering the electrical contacts, or the like. Without limitation, the electrical contacts of the base may comprise spring loaded charging pins, or so-called "pogo pins," that contact corresponding electrical contacts that are exposed at an outer surface of the housing of the hair styling tool. In some embodiments, the base may include an actuation element that brings the electrical contacts of the base into contact with the electrical contacts of the hair styling tool upon introducing the hair styling tool into the receptacle. The actuation element may comprise a mechanism that, upon being depressed by introduction of the hair styling tool into the receptacle, moves the electrical contacts into to position. Alternatively, the base may include other embodiments of electrical contacts, such as spring-loaded electrical contacts, fixed electrical contacts, and the like.

Power may be supplied from an external power source to the base by way of a conventional power cord. In some embodiments, the conventional power cord may comprise a conventional AC/DC adapter (e.g., the AC/DC adapter may be plugged into an AC outlet, while a DC connector may plug into the base, etc.). In other embodiments, the conventional power cord may comprise a power cord that carries AC from the external power source to the base, and the base may carry an AC/DC adapter, from which DC may be carried (e.g., by wires, circuitry on a circuit board, etc.) to the electrical contacts.

Hair styling systems including a hair styling tool and one or more charging elements are another aspect of this disclosure. Such a hair styling system may include a hair styling tool and an AC/DC adapter, a hair styling tool and a charging base, or a hair styling tool and both an AC/DC adapter and a charging base.

In use, yet another aspect of this disclosure, the hair styling feature of the hair styling tool may be heated while the hair styling tool is connected to an external power source (e.g., to the electrical grid or a larger capacity battery by way of a charging cord connecting the hair styling tool to an electrical outlet, by way of a charging base connecting the hair styling tool to an electrical outlet, etc.). By heating the hair styling feature while the hair styling tool receives power from the electrical grid, power stored by the battery of the hair styling tool may be conserved.

Once the hair styling feature has been heated to a target temperature (e.g., a temperature sufficient for styling hair, etc.), the hair styling tool may be uncoupled from the external power source. At this point, power from the battery of the hair styling tool may maintain the temperature of the hair styling feature while the hair styling tool is used to style an individual's hair. Once hair styling is complete, the hair styling tool may be reconnected to the charging element (e.g., reconnected to the charging cord, reintroduced into the receptacle of the charging base, etc.) to recharge the battery of the hair styling tool.

In some embodiments, the hair styling tool may continue to receive power from the external power source, for example, by way of a charging cord. Operation of the hair styling tool off power from the external power source may be useful when the battery lacks a sufficient electrical charge to completely style an individual's hair.

Other aspects of the disclosed subject matter, as well as features and advantages of various aspects of the disclosed subject matter, will become apparent to those of ordinary skill in the art though consideration of this disclosure, the accompanying drawing, and the appended claims.

DETAILED DESCRIPTION

Figures 1, 2, 3, 4:
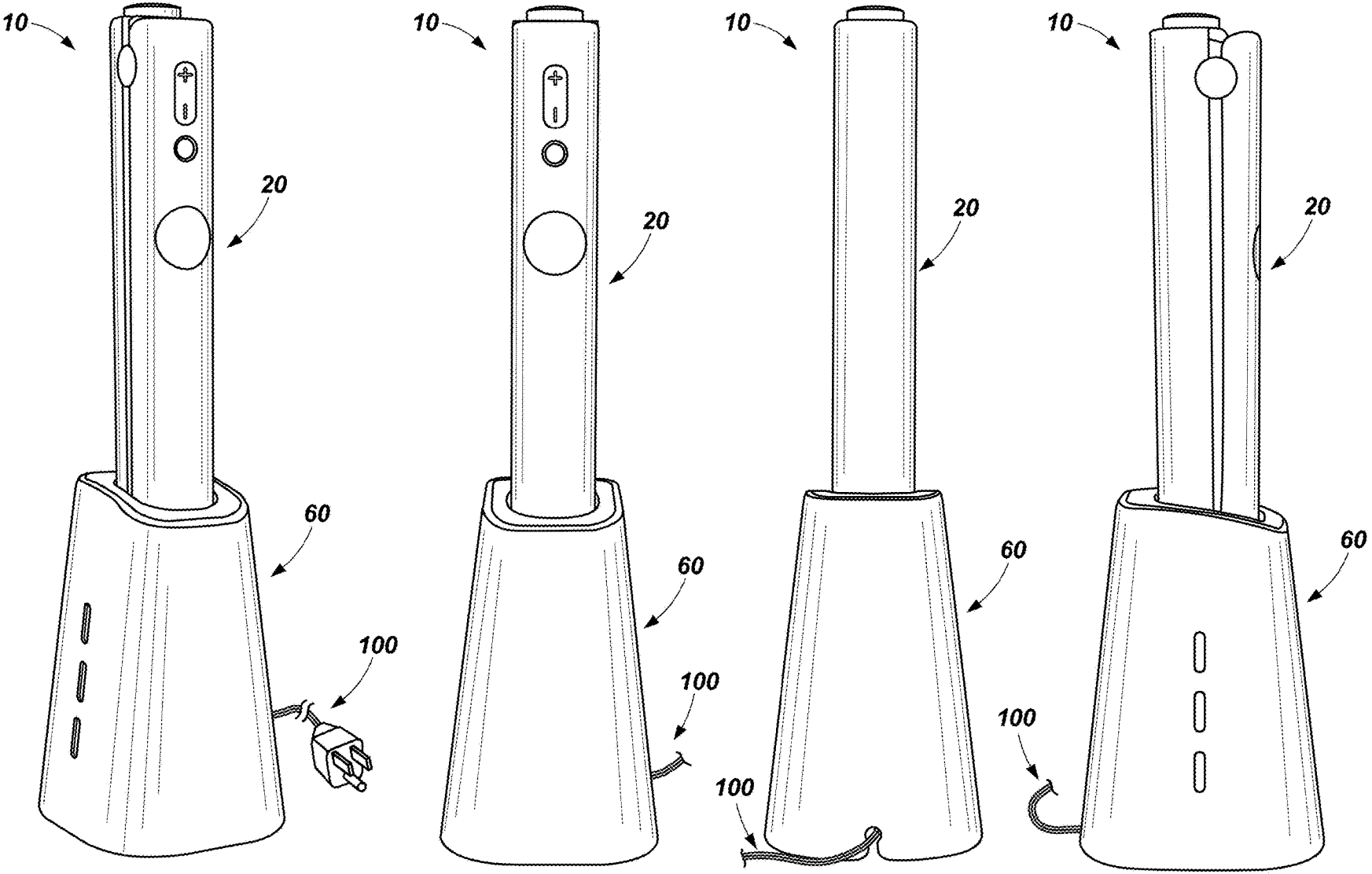
FIG. 1 is a perspective view of an embodiment of hair styling system that includes a base and a wireless hair styling tool, showing the base and the wireless hair styling tool in an assembled relationship.
FIG. 2 is a front view of the hair styling system shown in FIG. 1.
FIG. 3 is a rear view of the hair styling system shown in FIG. 1.
FIG. 4 is a side view of the hair styling system shown in FIG. 1.
Figure 8:
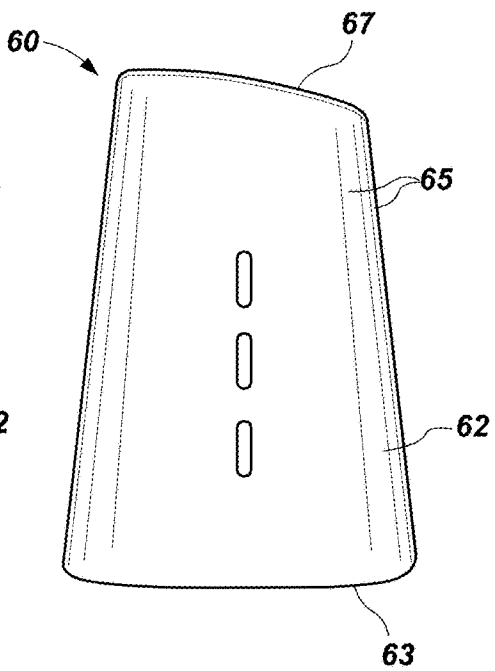
FIG. 8 is a side view of the base shown in FIG. 5.
Figure 7:
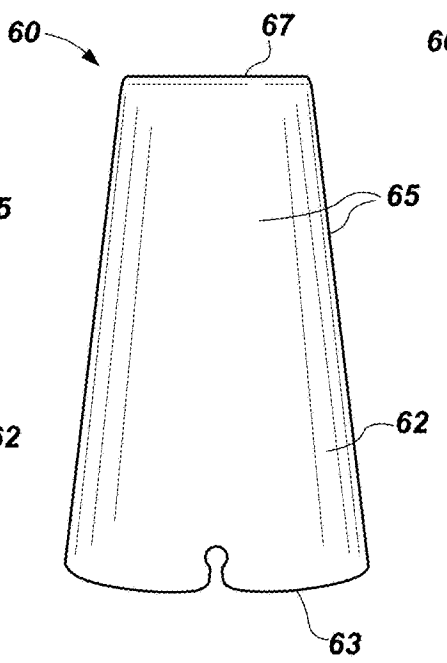
FIG. 7 is a rear view of the base shown in FIG. 5.
Figure 6:
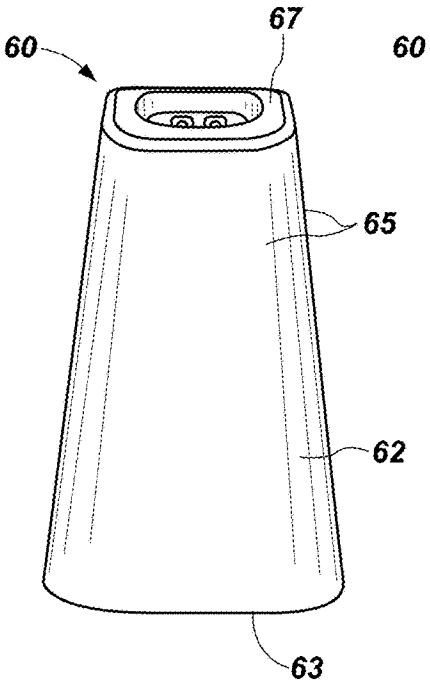
FIG. 6 is a front view of the base shown in FIG. 5.
Figure 5:
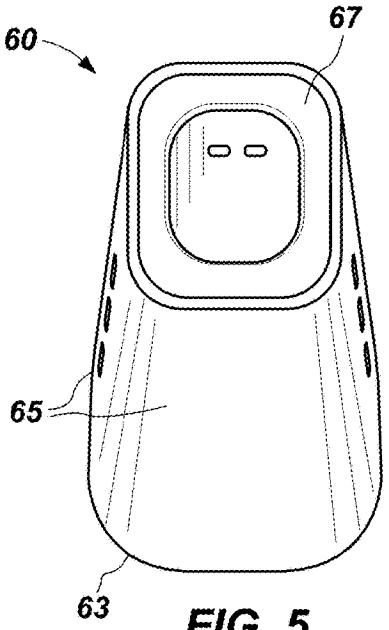
FIG. 5 is a perspective view of the base of the hair styling system shown in FIG. 1.
Figure 9:
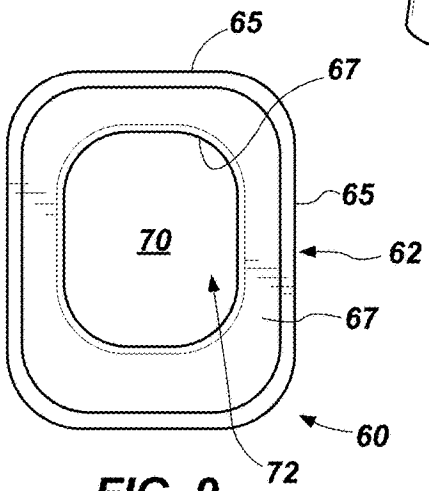
FIG. 9 is a top view of the base shown in FIG. 5, showing a receptacle within the base.

FIGS. 1-4 illustrate an embodiment of a wireless hair styling system 10 according to this disclosure. The wireless hair styling system 10 includes a hair styling tool 20, a base 60, and a power source 100. The base 60 has a configuration that enables it to releasably receive and support the hair styling tool 20. The power source 100 supplies power to the base 60, which, in turn, supplies power to a hair styling tool 20 assembled with and supported by the base 60.

Turning to FIGS. 5-11, various features of the base 60 of the wireless hair styling system 10 are disclosed. The illustrated embodiment of base 60 includes a housing 62 with a bottom surface 63, peripheral surfaces 65, and an upper surface 67. A receptacle 70 is recessed in the upper surface 67 of the housing 62 and extends from the upper surface 67 toward the bottom surface 63.

The bottom surface 63 of the housing 62 of the base 60 may be configured to rest upon a surface that is oriented horizontally or substantially horizontally. Without limitation, the bottom surface 63 may have a configuration that enables it to be supported upon a countertop, a tabletop, or the like. The embodiment of base 60 depicted by FIGS. 5-11 has a housing 62 with a bottom surface 63 with an outer periphery that has a rectangular shape. Corners of the outer periphery of the bottom surface 63 may be rounded.

In various embodiments, the bottom surface 63 may include one or more supports 64. Each support 64 may enable the bottom surface 63 of the housing 62 and, thus, the base 60 to rest stably upon a surface on which the base 60 is placed. The support(s) 64 may prevent the base 60 from damaging (e.g., scratching, scuffing, etc.) the surface on which the base 60 has been placed. The support(s) 64 may prevent the base 60 from slipping or sliding along the surface. The support(s) 64 may at least temporarily secure the base 60 to a surface on which the base 60 is placed.

The support(s) 64 may comprise any of a variety of suitable materials. Without limitation, each support 64 may comprise a material that is compressible. In some embodiments, such a material may also be resilient. As an example, each support 64 may comprise a felt fabric. As another example, each support 64 may comprise a polymer, such as an elastomer. Supports 64 formed from other materials are, of course, also within the scope of this disclosure.

In some embodiments the base 60 may include a plurality of discrete supports 64 (e.g., feet, etc.) on the bottom surface 63 of its housing 62. In other embodiments, the base 60 may include a support 64 that has an annular shape; such a base 60 may be positioned adjacent to an outer periphery of the bottom surface 63. In still other embodiments, the support 64 may extend across the bottom surface 63 (e.g., substantially across the bottom surface 63 (i.e., only peripheral portions of the bottom surface 63 may be exposed beyond the support 64); the support 64 may extend across an entirety of the bottom surface 63; etc.).

The peripheral surfaces 65 and the upper surface 67 of the housing 62 of the base 60 may impart the base 60 with a desired aesthetic appearance. While the appearance of the base 60 may differ from that illustrated by FIGS. 5-11, the peripheral surfaces 65 may be generally planar and somewhat diagonally oriented, tapering inward from an outer periphery of the bottom surface 63 of the housing 62 toward an outer periphery of the upper surface 67 of the housing 62. As an alternative to the planar peripheral surfaces 65 shown in FIGS. 5-11, one or more of the peripheral surfaces 65 may be curved or otherwise contoured. As an alternative to the diagonal, inwardly tapered orientations of the peripheral surfaces 65 shown in FIGS. 5-11, one or more of the peripheral surfaces 65 may be oriented perpendicular to the bottom surface 63 or taper outwardly from the peripheral edge(s) of the bottom surface 63.

Figure 10:
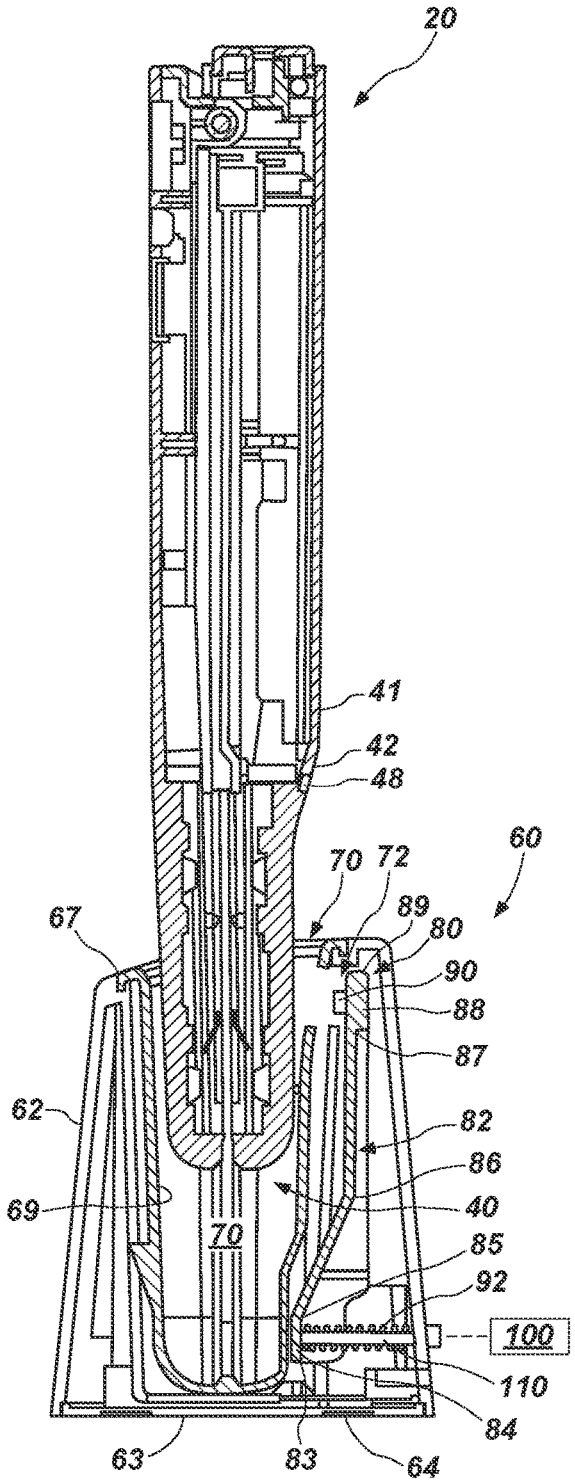
FIG. 10 is a cross-sectional representation of the base shown in FIG. 5, depicting a switch within the receptacle shown in FIG. 9, with the switch in an off position.
Figure 11:
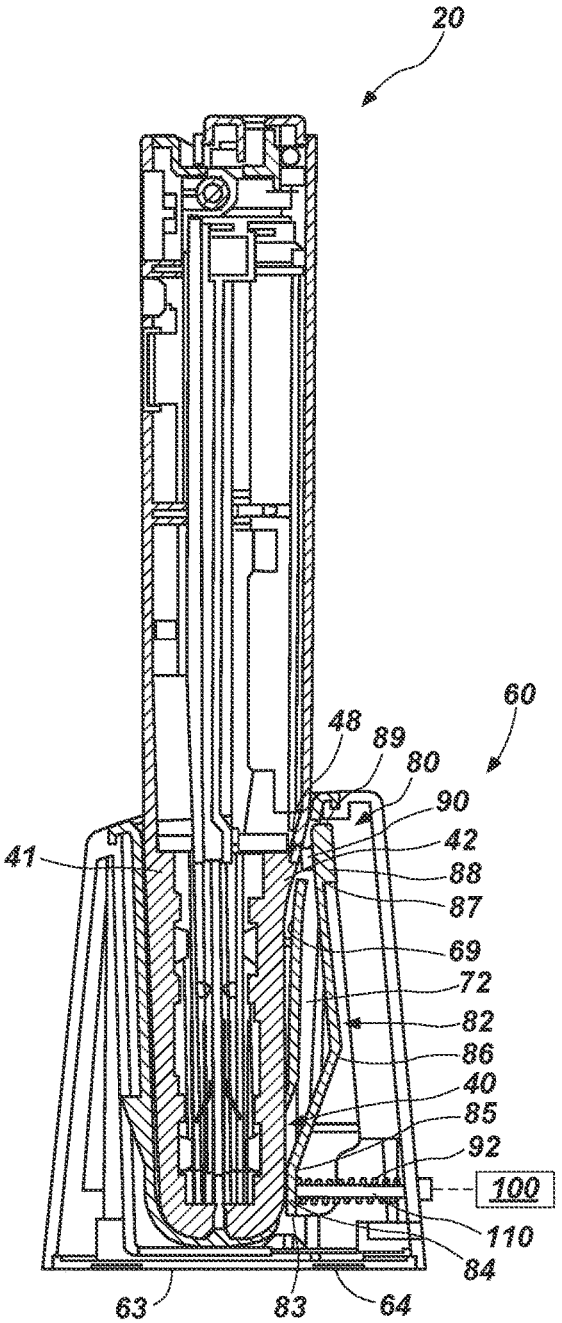
FIG. 11 is a partial cross-sectional representation of the hair styling system shown in FIG. 1, showing a tip of the wireless hair styling tool within the receptacle of the base and the switch of FIG. 10 in an on position.

As illustrated by FIGS. 10 and 11, an interior wall 69 of the housing 62 of the base 60 of the hair styling system 10 may define the receptacle 70 in the housing 62. The interior wall 69 may be defined from a thermally insulating material, such as a heat-resistant silicone. The receptacle 70 may have a configuration that enables it to receive a styling end 40 of a complementary hair styling tool 20. A shape of the receptacle 70 may correspond to, or complement, a shape of the styling end 40 of the hair styling tool 20.

The receptacle 70 of the base 60 may receive the styling end 40 of the hair styling tool 20, which carries the styling feature of the hair styling tool 20. The receptacle 70 may receive the entire styling feature 46 (FIGS. 12 and 15) (e.g., flat elements of a flat iron, grooved elements of a crimping iron, a substantially cylindrical element of a curling iron, heating elements of straightening brushes and heated roller brushes, etc.). In some embodiments, the receptacle 70 may receive the styling feature 46 in its entirety, for example, by completely laterally surrounding the styling feature 46. In such embodiments, the base 60 may prevent inadvertent contact (e.g., by an individual, etc.) with the styling feature 46 as the hair styling tool 20 is carried by the base 60.

A power source 100, such as the depicted power cord, may carry electricity from an external power source to the base 60. In some embodiments, the power source 100 may comprise or be coupled to an AC/DC adapter. In other embodiments, the power source 100 may supply AC to the base 60, which may carry an AC/DC adapter 110.

The housing 62 of the base 60 may include a switch 80 that controls the flow of power through the base 60 and into a hair styling tool 20 assembled with the base 60. More specifically, the switch 80 may remain in an off position until the styling end 40 of the hair styling tool 20 is inserted into the receptacle 70. Upon introducing the styling end 40 of the hair styling tool 20 into the receptacle 70, the switch 80 may be moved to an on position.

Safety measures may be included in the design of the base 60 to limit exposure of electrical contacts 90 of the base 60 while the electrical contacts 90 are electrified. For example, electricity may not flow to the electrical contacts 90 when the receptacle 70 of the base 60 is open or empty (e.g., it does not hold a portion of a hair styling tool 20, etc.). As another example, when the receptacle 70 of the base 60 is open or empty, access to the electrical contacts 90 may be physically limited, for example, by retracting the electrical contacts 90, covering the electrical contacts 90, or the like.

In the specific, but non-limiting embodiment shown in FIGS. 10 and 11, the switch 80 may comprise a lever 82. The lever 82 may also be referred to as a "pogo pin." The lever 82 may be positioned adjacent to a side 72 of the receptacle 70. The lever 82 may comprise an elongated element that includes a base section 84, an intermediate section 86, and a top section 88. The base section 84 and the top section 88 of the lever 82 may be oriented somewhat parallel to one another, but offset from each other by way of the intermediate section 86, which may be positioned diagonally between an intermediate end 85 of the base section 84 and an intermediate end 87 of the top section 88.

The top section 88 of the lever 82 of the switch 80 may carry electrical contacts 90 near a top end 89 of the lever 82. The electrical contacts 90 may be electrically connected to, or in electrical communication with, the power source 100 of the wireless hair styling system 10.

Figure 12:
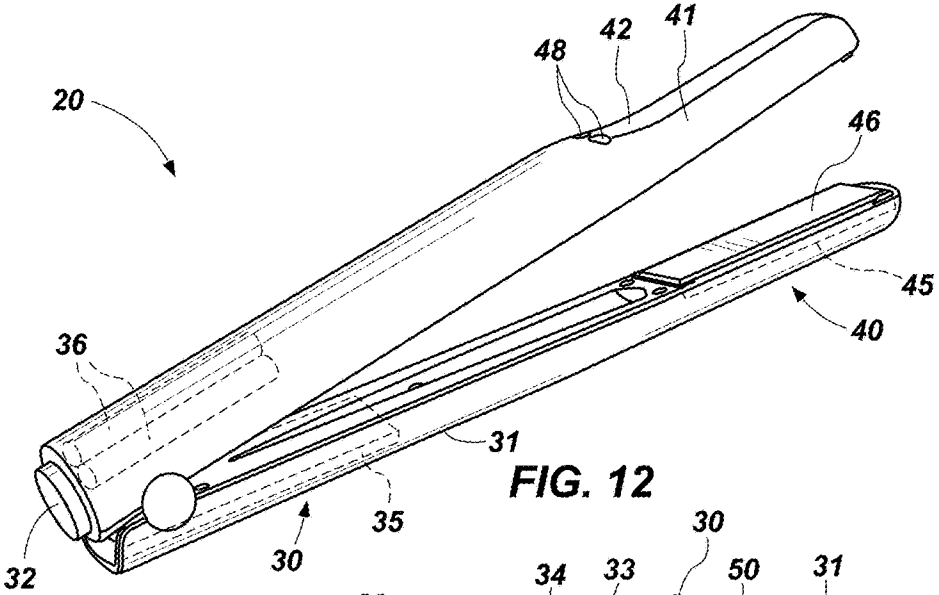
FIG. 12 is a perspective view of the wireless hair styling tool of the hair styling system shown in FIG. 1.
Figure 13:
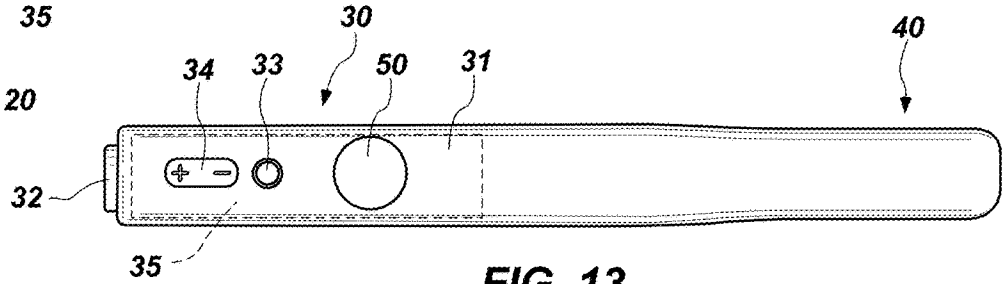
FIG. 13 is a top view of the wireless hair styling tool shown in FIG. 12.
Figure 14:
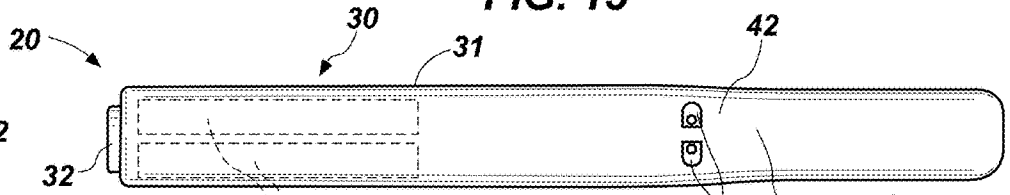
FIG. 14 is a bottom view of the wireless hair styling tool shown in FIG. 12.

A base end 83 of the base section 84 of the lever 82 may be held captive or at least partially captive within the receptacle 70. A spring 92 within the base 60 may bias, or resiliently force, the base end 83 toward a position and/or an orientation that enables the styling end 40 of the hair styling tool 20 to contact the base section 84 of the lever 82 when the styling end 40 has been fully inserted into the receptacle 70. As the styling end 40 of the hair styling tool 20 contacts the base section 84 of the lever 82, movement of the styling end 40 along the base section 84 of the lever 82 may cause the lever 82 to pivot. The top section 88 of the lever 84 may pivot or otherwise move toward another location on the styling end 40 of the hair styling tool 20. More specifically, introduction of the styling end 40 of the hair styling tool 20 into the receptacle 70 of the housing 62 of the base 60 may carry the electrical contacts 90 carried by the top section 88 of the lever 84 forward. As the electrical contacts 90 are carried forward, they may extend through one or more openings in the interior wall 69 of the housing 62 of the base 60. By moving the electrical contacts 90 forward, they may be brought into electrical contact with corresponding electrical contacts 48 on an outer surface 42 of a housing 41 of the styling end 40. Thus, power may flow from the power source 100 (FIGS. 10 and 11), to and through the electrical contacts 90 on the lever 84, to and through the electrical contacts 48 on the outer surface 42 of the housing 41 of the styling end 40 of the hair styling tool 20, and into electronic circuitry of the hair styling tool 20 (FIG. 12).

In addition to including a styling end 40, a hair styling tool 20 according to this disclosure includes a handle 30. Referring now to FIGS. 12-15, the handle 30 of the hair styling tool 20 may include a housing 31. The housing 31 may have a shape that enables it to be comfortably held and manipulated by a single hand of an individual, thereby facilitating single-handed use of the hair styling tool 20.

The housing 31 may carry various other elements of the hair styling tool 20. Without limitation, the housing 31 may carry a power connector 32, a power button 33, a temperature control 34, at least some of the electronics 35 of the hair styling tool 20, at least one battery 36, and a display 50 of the hair styling tool 20.

The power connector 32 may electrically couple electronics 35 of the hair styling tool 20 to an external power source 100 (FIGS. 10 and 11) and, thus, facilitate the supply of power from the external power source 100 to the electronics 35.

The power button 33 may communicate with the electronics 35. An individual may use the power button 33 to cause the electronics 35 to direct power to the heating element(s) 45. Each heating element 45 may be associated with a corresponding styling feature 46 in such a way that the heating element 45 transfers heat to the styling feature 46.

The temperature control 34 may also communicate with the electronics 35. In some embodiments, the temperature control 34 may include a spring-loaded toggle switch or pair of buttons. An individual may use the temperature control 34 to set a target temperature for the heating element(s) 45.

The electronics 35 may selectively control the flow of power to the battery(ies) 36 and one or more heating elements 45 of the hair styling tool 20. Thus, the electronics 35 may control operation of the hair styling tool 20. For example, the electronics 35 may include a switch (not a power button) and associated logic that control the flow of power through the circuitry of the hair styling tool 20 from the external power source 100 to the battery(ies) 36 and from the external power source 100 and/or the battery(ies) 36 to the heating element(s) 45. The circuitry of the electronics 35 may comprise a group of isolated circuits. The isolated circuits may be interconnected by the switch or by a plurality of switches that operate under control of the associated logic. In embodiments where the isolated circuits are interconnected by one or more switches, all of the features of the hair styling tool 20 that receive power from the isolated circuits may operate under DC power.

When the power button 33 is in an off position, the switch(es) of the electronics 35 may direct power from the external power source 100 to the battery(ies) 36 until the battery(ies) 36 is (are) fully charged. When the power button 33 is in an on position and the hair styling tool 20 is plugged into the external power source 100, the switch(es) of the electronics 35 may prioritize the direction of power from the external power source 100 to the heating element(s) 45 over the direction of power from the external power source 100 to the battery(ies) 36, which may enable the heating element(s) 45 to be heated to a target temperature before power is diverted to the battery(ies) 36 so it (they) can be charged. When the power button 33 is in the on position and the hair styling tool 20 is disconnected from the external power source 100, the switch(es) of the electronics 35 may direct power from the battery(ies) 36 to the heating element (s) 45.

In some embodiments, the switch(es) of the electronics 35 terminate the flow of power from the battery(ies) 36 to the heating element(s) 45 when the heating element(s) 45 is/are heated to the target temperature or a maximum threshold temperature that exceeds the target temperature (e.g., about 115% of the target temperature, about 110% of the target temperature, about 105% of the target temperature, the target temperature, etc.). As the temperature of the heating element(s) 45 drops to a minimum threshold temperature below the target temperature (e.g., about 95% of the target temperature, about 90% of the target temperature, about 85% of the target temperature, etc.), the switch(es) of the electronics may cause power to flow from the battery(ies) 36 to the heating element(s) 45 until the heating element(s) 45 is (are) again heated to the maximum threshold temperature. Thus, the switch(es) of the electronics 35 may cause power to flow from the battery(ies) 36 to the heating element(s) 45 in a controlled, intermittent manner.

The electronics 35 may also control a charge rate and/or discharge rate, or C-rate, of the battery(ies) 36. In addition, the electronics 35 may control operation of the display 50 of the hair styling tool 20.

The battery 36 of the hair styling tool 20 may comprise any suitable device for storing power. In a specific embodiment, the battery 36 may comprise one or more lithium ion polymer batteries. More specifically, a pair of lithium ion polymer batteries may be used. Each battery 36 may comprise a cylindrical cell. Each cylindrical cell may have a diameter of about 21 mm and a length of about 70 mm; i.e., it may comprise a so-called 21700 cylindrical cell lithium ion polymer battery. Each battery 36 may have a storage capacity of 5,000 mAh. In embodiments where the hair styling tool 20 includes a pair of batteries 36, they may have a collective storage capacity of 10,000 mAh. In embodiments where the heating element(s) 45 of the hair styling tool 20 are heated to an initial heated temperature or a maximum threshold temperature by power from the external power source 100, the battery(ies) 36 is (are) fully charged, and the hair styling tool 20 is then disconnected from the external power source 100, such a battery 36 may store sufficient power to maintain the heating element(s) 45 at or substantially at (e.g., within an acceptable range of, etc.) a target temperature for at least 30 minutes (e.g., at least 40 minutes, at least 45 minutes, at least an hour, etc.).

Figure 16:
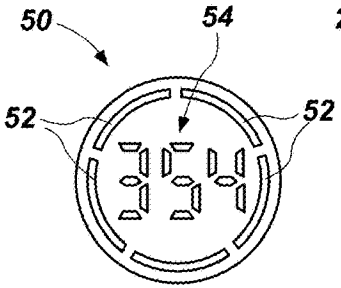
FIG. 16 is an enlarged view of a display on a top surface of the hair styling tool shown in FIG. 12.

The display 50 of the hair styling tool 20 may provide an individual with a variety of information regarding an operational state of the hair styling tool or one or more of its components. As illustrated by FIG. 16, the display 50 may include a battery indicator 52 and a temperature indicator 54. The display 50 may have a circular shape.

In embodiments where the display 50 has a circular shape, the battery indicator 52 may also be circular in shape. Such a battery indicator 52 may be located adjacent to an outer periphery of the display 50. When the battery(ies) 36 (FIG. 15) of the hair styling tool 20 (FIG. 15) is (are) fully charged, the battery indicator 52 may appear as a complete circle. When the battery(ies) 36 is (are) only partially charged, the battery indicator 52 may represent such a charge as a corresponding fraction of a circle (e.g., a battery charge of 75% would be represented by the battery indicator 52 as 75% of a circle, a battery charge of 50% would be represented by the battery indicator 52 as 50% of a circle (i.e., as a semicircle), a battery charge of 20% would be represented by the battery indicator 52 as 20% of a circle, etc.).

Figure 15:
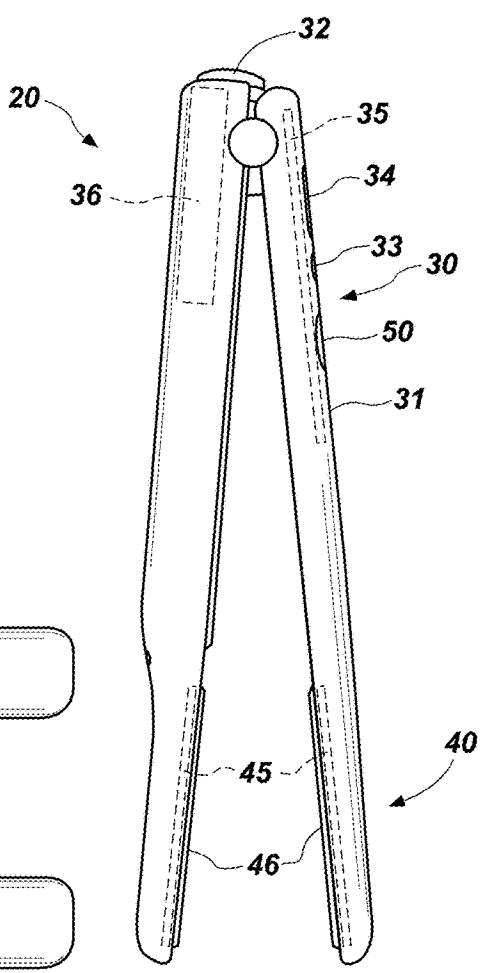
FIG. 15 is a side view of the wireless hair styling tool shown in FIG. 12.

In embodiments where the battery indicator 52 is circular, it may surround the temperature indicator 54. The temperature indicator 54 may display a numeric value. As an example, the temperature indicator 54 may display a target temperature for the heating element(s) 45 (FIGS. 12 and 15). Additionally, the temperature indicator 54 may provide an individual with some indication of the temperature(s) of the heating element(s) 45. For example, the displayed numeric value may flash until the heating element(s) 45 reach(es) the target temperature and then provide a constant display of the target temperature once the heating element(s) 45 has (have) been heated to the target temperature and while it (they) remain(s) at the target temperature. As the charge of the battery(ies) 36 (FIG. 15) approaches a level that is not sufficient to maintain the heating element(s) 45 at the target temperature, the temperature indicator 54 may provide a display indicating the same; in a specific embodiment, the temperature indicator 54 may display a "LoP" to indicate that the battery(ies) 36 are no longer or will soon be no longer able to maintain the heating element(s) 45 at the target temperature.

The styling end 40 of the hair styling tool 20 may carry the one or more heating elements 45, which, as described above, are in electrical communication with and operate under control of the electronics 35. In the depicted embodiment, the hair styling tool 20 comprises a flat iron with a styling end 40 that includes a pair of jaws 43 and 44 that are pivotally associated with one another. Each jaw 43, 44 carries a heating element 45. Each heating element 45 may comprise any suitable construction (e.g., an iron, aluminum, or titanium inner plate with a ceramic or titanium outer plate, etc.). In more specific embodiments, the inner plate of each heating element 45 may comprise iron, while the outer plate of each heating element 45 may comprise a tourmaline-infused ceramic. The inner plate of each heating element 45 may carry one or more temperature sensors that communicate with the electronics 35 to ensure that the temperature of each heating element 45 is maintained at or substantially at the target temperature (e.g., within a range of the target temperature, between the minimum threshold temperature and the maximum threshold temperature, etc.).

Although FIGS. 11-15 depict the styling end 40 of the hair styling tool 20 as a flat iron, it should be understood that hair styling tools 20 with other embodiments of styling ends 40 are also within the scope of this disclosure. As a few examples, the styling end 40 may be configured as a crimping iron, a curling iron, a styling wand, a heated round brush, or a heated paddle brush.

An outer cross-sectional shape of the styling end 40 of the hair styling tool 20 may correspond to a cross-sectional shape of receptacle 70 of the base 60 of the wireless hair styling system 10. In some embodiments, the outer cross-sectional shape of the styling end 40 may be keyed to the cross-sectional shape of the receptacle 70 to ensure that the styling end 40 is inserted into the receptacle 70 in the proper orientation and, thus, to ensure that the styling end 40 is not improperly inserted into the receptacle 70.

In addition to carrying the heating element(s) 45, the styling end 40 of the hair styling tool 20 may carry electrical contacts 48, as illustrated by FIGS. 10, 11, 12, and 14. The electrical contacts 48 may be located on an outer surface 42 of the housing 41 of the styling end 40 at a location that enables them to contact their corresponding electrical contacts 90 on the switch 80 within the base 60 of the wireless hair styling system 10, as shown in FIG. 11.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A hair styling system, comprising:
- a hair styling tool including:
  - a tool housing defining:
    - a handle;
  - a hair styling end:
    - adjacent to the handle; and
    - carrying a hair styling feature;
  - electronics:
    - that control operation of the hair styling feature; and
    - carried by the tool housing;
  - a battery:
    - in communication with the electronics; and
    - carried by the tool housing;
  - electrical contacts:
    - in communication with the electronics or the battery;
    - carried by the tool housing on the hair styling end and oriented flush with a surface of the tool housing; and
    - accessible from an exterior of the tool housing; and
- a base including:
  - a base housing;
  - a receptacle:
    - defined by the base housing; and
    - complementary to the hair styling end of the hair styling tool;
  - battery charging electronics:
    - carried by the base housing; and
  - electrical contacts:
    - in communication with the battery charging electronics;
    - complementary to the electrical contacts of the hair styling tool;
    - carried by an end of a lever that pivots within the receptacle; and
    - moveable upon pivoting the lever by introducing the hair styling end of the hair styling tool into the receptacle from a retracted, first location within the receptacle to an engaging, second location within the receptacle that will press the electrical contacts against the electrical contacts of the hair styling tool within the receptacle.

2. The hair styling system of claim 1, wherein the hair styling feature comprises a flat iron plate.

3. The hair styling system of claim 1, wherein the hair styling feature comprises a crimping plate.

4. The hair styling system of claim 1, wherein the hair feature tool comprises a curling plate.

5. The hair styling system of claim 1, wherein the hair styling feature comprises a straightening brush.

6. The hair styling system of claim 1, wherein the hair styling feature comprises a heated roller brush.

7. The hair styling system of claim 1, wherein the hair styling tool further includes:
- a charging port in the handle of the tool housing.

8. The hair styling system of claim 7, wherein the charging port is located at an end of the handle.

9. The hair styling system of claim 8, wherein the electronics of the hair styling tool can operate the hair styling feature while an AC/DC adapter is plugged into the charging port to charge the battery.

10. The hair styling system of claim 1, wherein the electrical contacts of the base comprise spring loaded charging pins.

11. The hair styling system of claim 1, wherein the base further includes:
- a switch that brings the electrical contacts into contact with the electrical contacts of the hair styling tool upon placement of the hair styling end of the hair styling tool within the receptacle of the base.

12. The hair styling system of claim 1, wherein the receptacle determines an orientation of the hair styling end of the hair styling tool relative to the base upon placement of the hair styling end within the receptacle of the base.

13. The hair styling system of claim 1, wherein the base stores the hair styling tool in an upright orientation.

14. The hair styling system of claim 1, wherein the base comprises a thermally insulating material.

* * * * *